US008627963B2

(12) United States Patent
Durdin et al.

(10) Patent No.: US 8,627,963 B2
(45) Date of Patent: Jan. 14, 2014

(54) HYDROCYCLONE REJECT ORIFICE TREATED TO PREVENT BLOCKAGE

(75) Inventors: Ian Durdin, Tividale (GB); Nigel Abraham, Birmingham (GB)

(73) Assignee: Cameron International Corporation, Houston, TX (US)

( * ) Notice: Subject to any disclaimer, the term of this patent is extended or adjusted under 35 U.S.C. 154(b) by 251 days.

(21) Appl. No.: 13/130,792

(22) PCT Filed: Dec. 22, 2009

(86) PCT No.: PCT/US2009/069230

§ 371 (c)(1), (2), (4) Date: May 24, 2011

(87) PCT Pub. No.: WO2010/075403

PCT Pub. Date: Jul. 1, 2010

(65) Prior Publication Data

US 2011/0240532 A1 Oct. 6, 2011

Related U.S. Application Data

(60) Provisional application No. 61/140,184, filed on Dec. 23, 2008.

(51) Int. Cl.
*B04C 5/26* (2006.01)

(52) U.S. Cl.
USPC ..... 209/725; 209/732; 210/512.1; 210/512.2

(58) Field of Classification Search
USPC ..... 209/725; 210/512.1, 512.2
See application file for complete search history.

(56) References Cited

U.S. PATENT DOCUMENTS

| | | | | |
|---|---|---|---|---|
| 5,042,169 | A * | 8/1991 | Vero | 34/591 |
| 6,109,451 | A * | 8/2000 | Grimes | 209/725 |
| 7,011,219 | B2 * | 3/2006 | Knox-Holmes et al. | 209/725 |
| 2004/0134852 | A1 | 7/2004 | Kampfer | |
| 2007/0215541 | A1 * | 9/2007 | Kampfer | 210/512.2 |

* cited by examiner

*Primary Examiner* — Terrell Matthews
(74) *Attorney, Agent, or Firm* — Mossman Kumar & Tyler PC

(57) ABSTRACT

A reject port of a hydrocyclone has an orifice that is treated or coated to prevent blockage thereof when materials pass therethrough, such as produced water, asphaltenes, waxes, "schmoo" or other materials having high potential for scaling. Such surfaces may include, but are not necessarily limited to, superhydrophobic surfaces and/or superoleophobic surfaces such as polytetrafluoroethylene (PTFE), fluorinated ethylene propylene (FEP), perfluoroalkoxy (PFA), tungsten disulfide (WS2), siloxanes, nanomaterials, surfaces created by diffusion of carbon into a stainless steel without forming chromium carbides (e.g. KOLSTERISING®), anti-scale treatment materials, and combinations thereof. The treated orifice may optionally be removable from the reject port.

9 Claims, 1 Drawing Sheet

HYDROCYCLONE REJECT ORIFICE TREATED TO PREVENT BLOCKAGE

BACKGROUND OF THE INVENTION

The present invention relates to methods and apparatus for improved hydrocyclones, and particularly relates, in one non-limiting embodiment, to hydrocyclones having orifices that have been treated, coated or otherwise modified to have a surface that is more resistant to blockage or plugging than prior to the treatment, coating or modification.

Hydrocyclones are well known. They are devices to classify, separate or sort liquids and/or particles in a liquid mixture based on the densities of the liquids, or in suspension based on the densities of the particles. That is, a hydrocyclone may be used to separate solids from liquids or to separate liquids of different density. A hydrocyclone will normally have a cylindrical section at the top where liquid is fed tangentially and a conical base. The angle, and hence length of the conical section, plays a role in determining operating characteristics.

A hydrocyclone often has two exits on the axis in opposing directions: the larger on the underflow or accept and a smaller at the overflow or reject. In the context herein, the terms "reject" and "overflow" are used interchangeably. The underflow is generally the denser or thicker fraction, while the overflow is the lighter or more fluid fraction. The terms "reject" or "accept" tend to be value judgments on the worth of the respective exiting streams.

Internally, centrifugal forces are generated by the rapid acceleration of the fluids through the inlet ports of the hydrocyclone. Denser particles or fluids migrate towards the wall for eventual exit via the underflow, whilst the finer, or less dense particles and fluids migrate towards the core, remain in the liquid and exit at the overflow through a tube extending slightly into the body of the cyclone at the center or through a reject port.

Solid-liquid hydrocyclones and liquid-liquid hydrocyclones differ in some features. For instance, the diameter of the overflow or reject ports in liquid-liquid hydrocyclones tend to have relatively smaller diameters for a given cyclone body diameter. Additionally, the cone angles on solid-liquid hydrocyclones tend to be in excess of 20° included angle whereas for liquid-liquid hydrocyclones the included angle tends to be less than 5° or be a continuous acceleration geometry.

Liquid-liquid hydrocyclones commonly have a relatively small reject port, typically having an internal diameter of from about 1.5 to about 5 mm, through which the lighter phase fraction exits. The accumulation of foreign material or contaminants in this orifice over time causes constriction or plugging and this restriction or plugging restricts or inhibits the flow of the lighter phase leading to a reduction in hydrocyclone performance.

Normal operation would require these orifices to be "backflushed", that is, to reverse the flow of fluid through the reject orifice, which process aims to use the differential hydraulic pressure to dislodge the obstructing material. In certain applications where the differential pressure is limited or the solids have a high affinity for the orifice surface, the backflushing is often not successful. Also, fluids pass through the path of least resistance, so if only one orifice of many is blocked, it becomes difficult to dislodge the foreign matter because the backflush fluids pass through the unblocked orifices.

It would be desirable if methods and apparatus were devised that could provide orifices that were less susceptible to blocking or plugging.

BRIEF SUMMARY OF THE INVENTION

There is provided, in one non-restrictive form, a hydrocyclone that has a reject port, where the reject port in turn has a body and an orifice bearing a surface having a coefficient of friction that is lower than the coefficient of friction of the body of the reject port.

There is also provided, in another non-limiting embodiment, a reject port for a hydrocyclone that has an orifice defined at least partially by a surface with a low coefficient of friction. The surface may be polytetrafluoroethylene (PTFE), fluorinated ethylene propylene (FEP), perfluoroalkoxy (PFA), tungsten disulfide ($WS_2$), siloxanes, nanomaterials, superhydrophobic materials, superoleophobic materials, diffusion of carbon into the parent metal (e.g. a stainless steel) without forming chromium carbides (e.g. KOLSTERISING® process), anti-scale treatment materials, locally ionizing materials, catalytic coating materials, magnetic materials, surface active materials, and combinations thereof.

Optionally, the orifice is formed in a body that is removable from the reject port.

It will be appreciated that the Figures are schematic illustrations that are not to scale or proportion, and, as such, some of the important parts of the invention may be exaggerated for illustration.

DETAILED DESCRIPTION OF THE INVENTION

It has been discovered that by applying a material or treatment to the surface of a reject orifice that the resultant material properties of that surface prevent or reduce or inhibit the accumulation of foreign matter in the reject orifice. Such a surface or material may be understood has having a low friction coefficient, as "self-cleaning" or both. The surface may be hydrophobic and/or hydrophilic (e.g. oleophobic and/or lipophobic). In one non-limiting embodiment, the surface, coating or treatment may need to be re-applied or the surface may need to be retreated, if the surface or treatment is one that wears out or diminishes over time. Optionally, the orifice of the reject port may be removable or replaceable with a new orifice so that the original orifice may be re-treated or have the surface re-applied with little downtime in the operation of the hydrocyclone.

Figure 1:
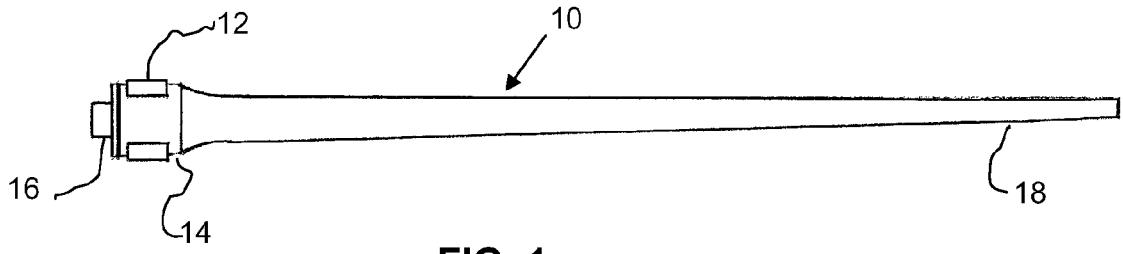
FIG. 1 is a schematic illustration of a hydrocyclone having at one end a reject port.

Shown in FIG. 1 is a schematic illustration of a hydrocyclone 10 having an inlet 12 in a generally cylindrical inlet or head section, also called an involute 14, an overflow or reject outlet 16 and an underflow portion 18, also referred to as the "tailpipe". In one non-limiting embodiment the hydrocyclone is a liquid-liquid hydrocyclone. A fluid mixture enters the inlet 12 under high fluid pressure, and there is lower fluid pressure proximate the respective outlets 16 and 18. As the details of such separation vessels are well known, they will not be described further here. Also those of skill in the art will understand that the hydrocyclone assembly 10 includes numerous other components and systems that are not germane to the present apparatus and system and, therefore, are not described in any detail here. Suitable metals for the hydrocyclones herein include, but are not necessarily limited to, casting materials such as duplex stainless steel alloys, stellite alloys, steel, HASTELLOY® corrosion-resistant metal alloys (trademark of Haynes International, Inc.), and also tungsten carbide, silicon carbide, alumina ceramic, zirconia ceramic, and the like.

Figure 2:
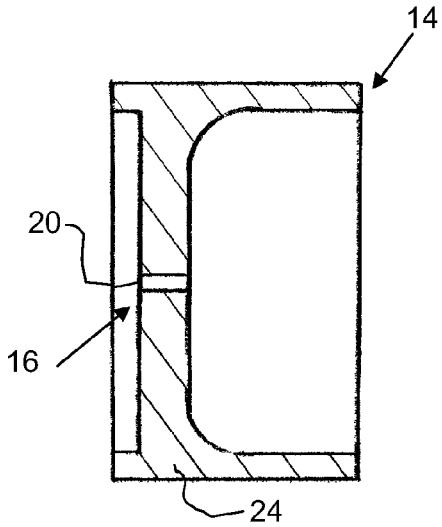
FIG. 2 is a schematic, cross-sectional illustration of a reject port having an orifice with a surface that has a low coefficient of friction.

Shown in FIG. 2 is a schematic, cross-sectional illustration of a reject or overflow port 16 such as would be in hydrocyclone 10 of FIG. 1. The reject port 16 has an orifice 20 with a surface, i.e. the surface of the inner diameter of orifice 20, that has a low coefficient of friction. In one non-limiting embodiment, this surface has a cylindrical shape. By "low coefficient of friction" is meant that the coefficient of friction of the orifice surface 20 is lower than that of the material of the orifice, in this case also the material of the body 24 of reject port 16. In another non-limiting embodiment, the term "low coefficient of friction" is defined as below 0.3 at the physical conditions of application for the materials and fluids involved. It will be appreciated that this non-restrictive figure is only a guide, and that others may not consider this to be low. Alternatively, the low coefficient of friction is defined as below 0.28, 0.26, 0.24, 0.22, 0.20, 0.18, 0.16, 0.14, 0.12 or even below 0.10, in alternative definitions. The body 24 of reject port 16 may be any of the materials previously noted as suitable for hydrocyclones or those otherwise known in the art.

Typical inner diameters of orifices of reject ports for liquid-liquid hydrocyclones may range from about 1.5 to about 5 mm. However, it will be appreciated that the methods, surfaces and structures herein are not limited to a particular inner diameter, but are widely applicable. It will be appreciated that an advantage of the methods and structures described herein is that by using a relatively smaller diameter orifice, in an oil/water separation, the volume of water undesirably discharged with the oil fraction may be restricted or inhibited.

The surface having the relatively low coefficient of friction may be provided in a variety of ways. Suitable materials and treatments include, but are not necessarily limited to, polytetrafluoroethylene (PTFE), fluorinated ethylene propylene (FEP), perfluoroalkoxy (PFA), tungsten disulfide ($WS_2$), siloxanes, nanomaterials, superhydrophobic materials, superoleophobic materials, surfaces created by diffusion of carbon into a stainless steel without forming chromium carbides (KOLSTERISING®), anti-scale treatment materials, locally ionizing materials, catalytic coating materials, magnetic materials, surface active materials, and combinations thereof.

Suitable superhydrophobic and superoleophobic materials include, but are not necessarily limited to, PTFE, FEP, PFA, $WS_2$, siloxanes, polysiloxanes, and combinations thereof. Some of these materials may also be suitable anti-scale treatment materials. Anti-scale materials are defined herein as those that prevent scale build-up through chemical or catalytic reactions or due to the surface structure of the materials. The diffusion of carbon into the parent metal (in a non-limiting example, stainless steel) without forming chromium carbides is known as the KOLSTERISING® process, which is a trademark of Bodycote. In the present context, "superhydrophobic" is defined as a material that causes a water droplet to have a contact angle with the surface in excess of 150° and a roll off angle of less than 10°, while "superoleophobic" is defined as a material that causes a hydrocarbon droplet to have a contact angle with the surface in excess of 150° and a roll off angle of less than 10°. Of course, it will be appreciated that a hydrophobic or superhydrophobic surface is to be used if the reject or overflow material is aqueous, and that an oleophobic or superoleophobic surface is to be used if the reject or overflow material is oil-based. Nanomaterials in one non-limiting embodiment may be defined as composed of substances of a size of about 600 nm or smaller, alternatively as about 100 nm or smaller.

Figure 3:
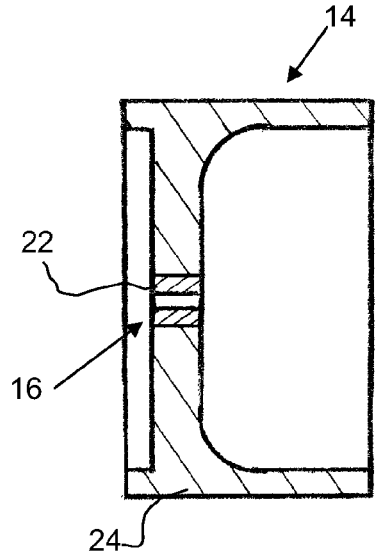
FIG. 3 is a schematic, cross-sectional illustration of an alternate embodiment of reject port having a removable orifice, where the orifice has a surface that has a low coefficient of friction.

Processes and treatments to apply the materials to the orifice 20, such as treatments or applications to the rejection port 16 and/or orifice casting (duplex steel/stellite/HASTELLOY® alloys) or to tungsten carbide, include a removable component or orifice 22, as shown in FIG. 3. In non-limiting embodiments, the removable component or orifice 22 may be screwed or threaded into the involute 14, or force-fit, or removably affixed in any way known in the art.

The expected or typical thicknesses for the surfaces, coatings or materials will likely depend on the type of coating, material or treatment applied, how long the coating is desired to last, and would be expected to range from several nanometers up to microns or even hundreds of microns. In one non-limiting embodiment, in the case of the KOLSTERISING process, the thickness of the surface ranges from about 20 to about 60 microns. A suitable thickness of $WS_2$ includes, but is not necessarily limited to, about 0.5 microns. The thickness of some of the "non-stick" coatings, such as PTFE and other polymers would be variable.

The surfaces, coatings and treatments described may be applied to all hydrocyclones, past, present and to be developed. These surfaces would be expected to find particular use in applications where scaling potential is high and/or solids are present in the produced water, for instance materials such as asphaltenes, waxes, and schmoo (a "catch-all" phrase for slimy, oily substances or deposits that adhere to almost any surface it contacts, and which is difficultly removed).

In the foregoing specification, the invention has been described with reference to specific embodiments thereof, and is expected to be effective in providing methods and orifices that have less tendency for sticking, plugging or clogging during use, and also during cleaning or backflushing. However, it will be evident that various modifications and changes may be made thereto without departing from the broader scope of the invention as set forth in the appended claims. Accordingly, the specification is to be regarded in an illustrative rather than a restrictive sense. For example, the hydrocyclone, rejection port, low coefficient of friction surface and orifice may be changed or optimized from that illustrated and described, and even though certain additional features are not specifically identified or tried in a particular system, method or apparatus describe herein, they would be anticipated to be within the scope of this invention. For instance, the materials, surfaces, coatings and treatments to an orifice, other than those described, would be expected to find utility and be encompassed by the appended claims.

The present invention may suitably comprise, consist or consist essentially of the elements disclosed and may be practiced in the absence of an element not disclosed.

The words "comprising" and "comprises" as used throughout the claims is to interpreted "including but not limited to".

What is claimed is:

1. An overflow port for a liquid-liquid hydrocyclone comprising an orifice defined at least partially by a surface having a low coefficient of friction, where the surface is selected from the group consisting of polytetrafluoroethylene (PTFE), fluorinated ethylene propylene (FEP), perfluoroalkoxy (PFA), tungsten disulfide ($WS_2$), a siloxane, a nanomaterial, a superhydrophobic material, a superoleophobic material, diffusion of carbon into a parent metal without forming a chromium carbides, an anti-scale treatment material, a locally ionized material, a catalytic coated material, a magnetic material, a surface active material, and combinations thereof.

2. The overflow port of the liquid-liquid hydrocyclone of claim 1 where the surface is a coating having a thickness of from 0.5 to 60 microns.

3. The overflow port of the liquid-liquid hydrocyclone of claim 1 where the orifice is formed in a body that is removable from the overflow port.

4. A liquid-liquid hydrocyclone comprising an overflow port, the overflow port comprising a body and an orifice defined at least partially by a surface having a coefficient of friction that is lower than the coefficient of friction of the body of the overflow port of the liquid-liquid hydrocyclone.

5. The liquid-liquid hydrocyclone of claim 4 where the surface of the orifice is selected from the group consisting of polytetrafluoroethylene (PTFE), fluorinated ethylene propylene (FEP), perfluoroalkoxy (PFA), tungsten disulfide ($WS_2$), a siloxane, a nanomaterial, a superhydrophobic material, a superoleophobic material, diffusion of carbon into a parent metal without forming a chromium carbide, an anti-scale treatment material, a locally ionized material, a catalytic coated material, a magnetic material, a surface active material and combinations thereof.

6. The liquid-liquid hydrocyclone of claim 4 where the surface is a coating having a thickness of from 0.5 to 60 microns.

7. The liquid-liquid hydrocyclone of claim 4 where the orifice is formed in a body that is removable from the overflow port.

8. A liquid-liquid hydrocyclone comprising an overflow port, the overflow port comprising a body and an orifice defined at least partially by a surface having a coefficient of friction that is lower than the coefficient of friction of the body of the overflow port of the liquid-liquid hydrocyclone, where the surface is a coating of the orifice, where the coating has a thickness of from 0.5 to 60 microns, and where the surface of the orifice is selected from the group consisting of polytetrafluoroethylene (PTFE), fluorinated ethylene propylene (FEP), perfluoroalkoxy (PFA), tungsten disulfide ($WS_2$), a siloxane, a nanomaterial, a superhydrophobic material, a superoleophobic material, diffusion of carbon into a parent metal without forming a chromium carbide, an anti-scale treatment material, a locally ionized material, a catalytic coated material, a magnetic material, a surface active material and combinations thereof.

9. The liquid-liquid hydrocyclone of claim 8 where the orifice is formed in a body that is removable from the overflow port of the liquid-liquid hydrocyclone.

* * * * *